US006052106A

United States Patent [19]

Maltese

[11] Patent Number: 6,052,106

[45] Date of Patent: Apr. 18, 2000

[54] CONTROL METHOD FOR A FERROELECTRIC LIQUID CRYSTAL MATRIX PANEL

[75] Inventor: Paolo Maltese, Rome, Italy

[73] Assignee: Universita Degli Studi Di Roma Sapienza, Italy

[21] Appl. No.: 08/693,315

[22] PCT Filed: Feb. 22, 1995

[86] PCT No.: PCT/IT95/00029

§ 371 Date: Aug. 16, 1996

§ 102(e) Date: Aug. 16, 1996

[87] PCT Pub. No.: WO95/23402

PCT Pub. Date: Aug. 31, 1995

[30] Foreign Application Priority Data

Feb. 25, 1994 [IT] Italy ..... RM94A0102

[51] Int. Cl.[7] ..... G09G 3/36

[52] U.S. Cl. ..... 345/97

[58] Field of Search ..... 345/94–98, 208–210

[56] References Cited

U.S. PATENT DOCUMENTS

| | | | |
|---|---|---|---|
| 5,095,377 | 3/1992 | Kobayashi et al. | 345/97 |
| 5,594,464 | 1/1997 | Tanaka et al. | 345/94 |
| 5,684,503 | 11/1997 | Nomura et al. | 345/97 |

OTHER PUBLICATIONS

SID International Conference 1993, Digest of Technical papers, 1993, pp. 642–645, P. Maltese et al. "Superfast Addressing Modes for SSFLC Matrix Displays".

Liquid Crystals, 1993, pp. 819–834, P. Maltese et al., "An Addressing Effective Computer Model for Surface Stabilized Ferroelectric Liquid Crystal Cells".

IBM Technical Disclosure Bulletin, vol. 36, No. 1, Jan. 1993, pp. 446–447, "Three–Slot Drive Scheme for Multiplexing of Ferroelectric Liquid–Crystal Shutter Devices".

*Primary Examiner*—Jeffery Brier
*Attorney, Agent, or Firm*—Smith, Gambrell & Russell

[57] ABSTRACT

Subject-matter of this invention is a control method for a ferroelectric liquid crystal matrix panel wherein use is made of selection voltages comprising, at each selection operation, at least two (write) pulses, that is voltages having substantially an identical polarity in finite time intervals, of the same polarity, spaced apart by an interruption wherein voltages of opposite polarity are present, as well specified. The absolute value of the time integral of the voltage during the second pulse (write post-pulse) is in the range of 0.2 Amin to 5 Amin. The control time window associated to the selection voltage includes time intervals wherein voltages of opposite polarity are applied in the interruption, comprehensively extending for at least one and no more than four fifths of the duration of said window, and the absolute value of the integral of the selection voltage in the assembly of said time intervals is in the range between 0.05 Amin and 1 Amin. Subject-matter of this invention is also a display device comprising a ferroelectric liquid crystal matrix panel as well as circuits to generate and apply respective control voltages according to the described method.

24 Claims, 4 Drawing Sheets

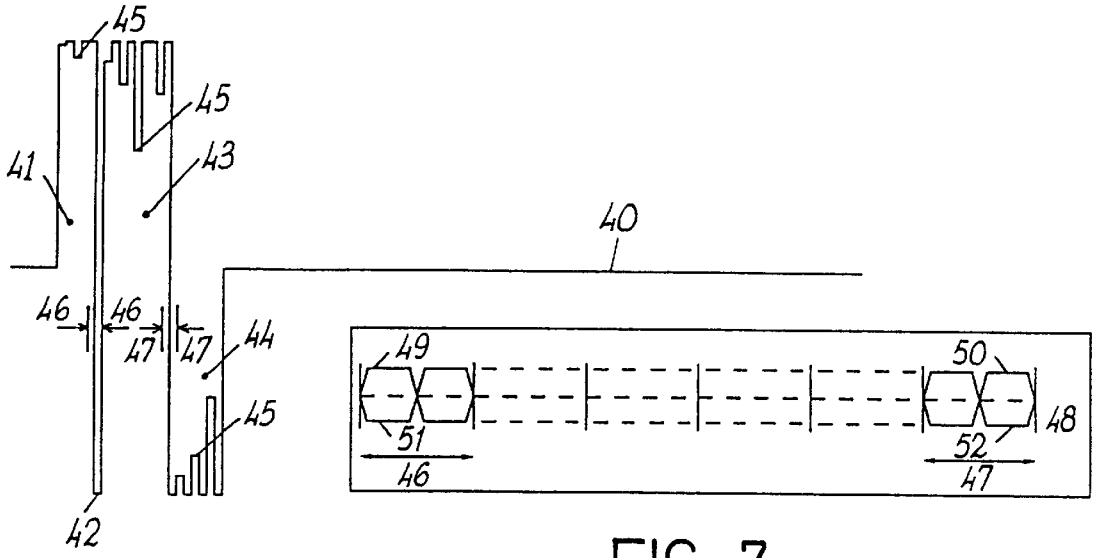
FIG. 7
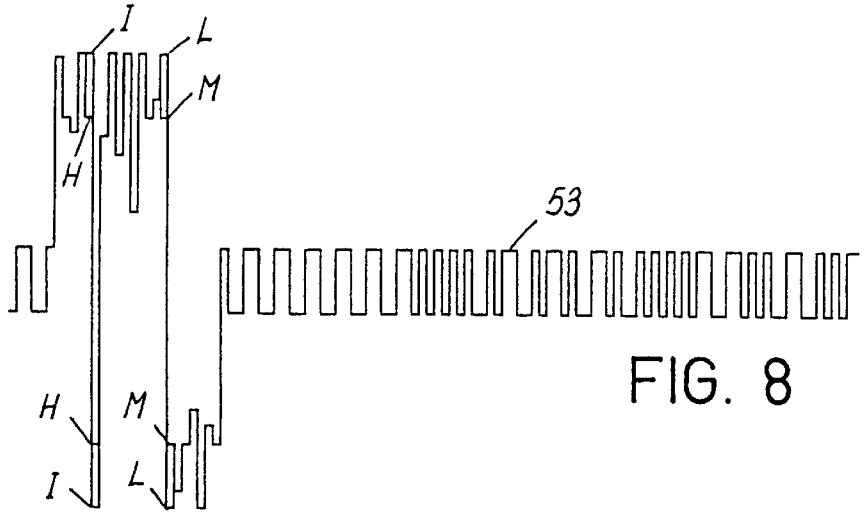
FIG. 8
FIG. 9
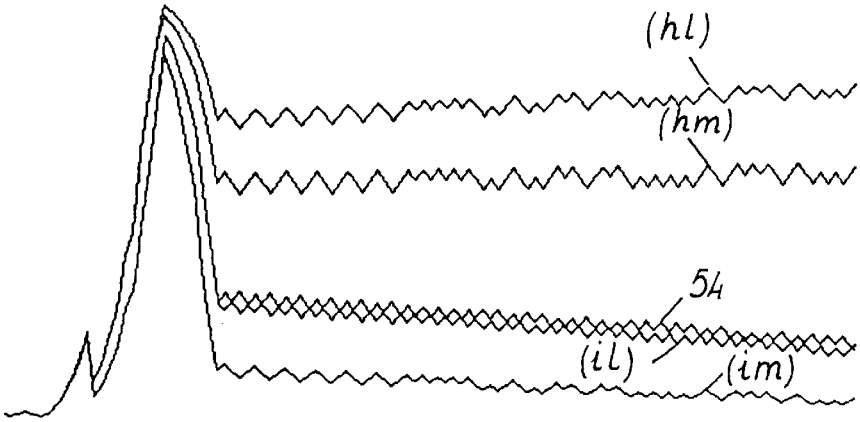

CONTROL METHOD FOR A FERROELECTRIC LIQUID CRYSTAL MATRIX PANEL

BACKGROUND OF THE INVENTION

1. Field of the Invention

This invention broadly relates to liquid crystal matrix panels and more particularly it refers to a control method for matrix panels of a direct addressing, ferroelectric liquid crystal (FLC) type, to enable their improved operation.

2. Description for the Related Art

As it is known, the panels to which this invention relates are used in devices for displaying images and for optical computation applications, both of the projection and of the direct vision types. In these devices, each picture element (pixel) ideally corresponds to the intersection of an element of a first electrode set (for instance arranged as rows) and an element of a second electrode set (for instance arranged as columns) and materially it corresponds to an electro-optical cell comprising a ferroelectric liquid crystal in the room existing between two facing electrodes belonging to the above mentioned two electrode sets. In usual arrangements, a pair of crossed polarisers operatively completes the cell and makes visible the orientation changes of the director in the liquid crystal that can be of the smectic C chiral type.

The panel consisting of FLC cells can be electrically controlled according to various addressing modes (or schemes) or modes for applying voltages and currents to the two electrode assemblies, so as to determine the states of all cells, the number of which is usually much higher than the number of electrodes. The main object of this invention is to provide a novel addressing method as hereinafter disclosed.

The device as a whole comprises the assembly of the described panel with the related electronic circuitry to generate the various voltage signals needed for its operation and the interconnection elements to the panel electrodes. According to the expected application, in addition, polarisers, colour filters, light sources and an optical system can be provided therein.

This invention additionally consists in the device comprising the above set forth assembly and operating according to the hereinafter described control method.

More precisely, this invention relates to a directly addressed FLC matrix panel wherein the ferroelectric liquid crystal cells operate according to a bistable or multistable behaviour in the absence of voltage or in the presence of a continuously applied, high frequency voltage having a sufficient and suitable rms amplitude, known as a high frequency or alternated current stabilisation voltage. As it will be explained, such a role can be played by the control voltages used, in particular, by the data voltages.

Under the term high frequency stabilisation, the phenomenon is usually meant where the stable states of a cell, when a high frequency voltage is present, are closer to the states that can be achieved by the continuous application of a dc voltage. A broader meaning is allotted in this patent description to the above term, since it also includes the phenomenon according to which the relaxation of a cell to a stable state becomes faster when a high frequency voltage is present.

The ferroelectric liquid crystal can be of the smectic C chiral type and the cells can be of the chevron type or of the partially or totally straightened up chevron type. In both cases, the smectic layers are approximately broken up into two halves, which are tilted in opposite directions with respect to a line normal to the cells, at an angle almost equal to (between 110% and 75% in the first case) or much smaller than (between 0% and 75% in the latter case) the characteristic angle of the SmC phase. Multi-stable behaviours can be related to microdomain mixtures of a number of stable states and the crystal can be utilised for storage of intermediate shades. Reference is made, for instance to P. Maltese, "Advances and problems in the development of ferroelectric liquid crystal displays", in Molecular Crystals and Liquid Crystals, Gordon and Breach, vol. 215, pages 57 and following and to the references cited therein.

By means of spaced apart rectangular pulses, of alternately opposite polarities, it is possible to obtain, as a result of each pulse, a cyclic transition of a cell from one extreme state to the other, possibly when a high frequency stabilisation voltage Vhf having a predetermined rms amplitude is present between such pulses. This effect occurs when such pulses have a duration which is higher than a sufficient value, that is a function of the amplitude of the pulses themselves (for a given rms stabilisation voltage). Such sufficient duration has a minimum value, corresponding to a voltage Vtmin, below which the product of each sufficient duration by the corresponding pulse voltage varies to a small extent but at the same time it has a minimum value Amin in the voltage range between one and eight tenths of Vtmin. Often it is not possible to apply to the cells—without damaging them—voltages sufficiently high to observe that the sufficient duration of the pulses increases as the voltage increases: in such case, the Vtmin should be evaluated by extrapolating the behaviours of the cells as observed at the applicable voltages and Amin will be the minimum value of the product duration-voltage in the range of the applicable voltage of one to eight tenths of Vtmin, or the value of the maximum applicable voltage, when it is less than one tenth of Vtmin.

A uniform cell is characterized by the above said three parameters, among which Amin is the most important, as well as by the dependence of Vtmin and Amin on Vhf. In view of the operation of the cell in the high voltage addressing modes, also comprising the subject-matter of this invention, as it will be further described, the significant values of Vtmin and Amin shall be determined in correspondence to a rms amplitude of Vhf equal to the one resulting from the addressing voltages used and, more precisely, from the data voltages and from any stabilisation voltage. As a matter of fact, such parameter values change from cell to cell of the panel, due to manufacturing tolerances (such as thickness differences) or to operation tolerances (such as temperature differences).

A mathematical model describing the operation of the cell during addressing is reported by P. Maltese et al in Digest of Technical Papers of 1993 Intl. SID Symposium, page 642 and following, available by Society for Information Display, 1526 Brookhollow Drive, Suite 82, Santa Ana, Calif. 92705-5421, as well as by P. Maltese et al, in vol. 15 (1993) of "Liquid Crystals", page 819 and following, as well as in the references cited in said scientific papers. Sufficiently small values of Vhf and Vtmin are achieved, as desired, when a large enough positive biaxiality is available of the dielectric constant tensor of the liquid crystal. For its definition, reference is made to the description of the model in the above quoted papers.

Many known addressing modes for FLC panels contemplate different operations wherein, by means of said voltage signals, it is possible to store all changes with respect to the previous image or to store a new image (write), after having erased the previous image (erasure or blanking), in well defined time intervals, which is meant by the "refresh" of the panel. Between successive refreshes, it is possible to hold images stored on the panel, both when voltages are absent and when voltages are present to control other portions of the panel and when any high frequency stabilisation voltages are present. As a matter of fact, the refresh rates are suitable to display also moving images.

In many cases, the display refresh is carried out electrode by electrode of a first set, according to a scanning scheme wherein the writing operation is contemporaneously performed for all pixels belonging to a given electrode, for instance row by row. This very common case, namely a row-by-row scanning scheme, will be often referred to hereinafter, by way of exemplification and not by way of limitation, for the sake of concreteness and simplicity of explanation. It should be apparent, in fact, that the roles of the rows and of the columns can be exchanged and that the electrodes can be arranged according to a quite different geometrical pattern.

Many already known addressing methods, therefore, provide for refreshing the panel on the basis of successive rows, in usually partially overlapping times, as determined by scanning or selection voltages applied to the row electrodes, independent of the images to be displayed. Said selection voltages, in correspondence to the refreshes, can comprise in the first place one or more pulses, namely even variable voltages, of substantially the same polarity in a finished time span, effecting blanking. These cause the erasure of the previously stored image, i.e. they switch the cells of a row into a well defined state, independently of the concurrently applied column voltages. As is also known, such erasure can also be carried out concurrently to the erasure or writing of other rows. The selection voltages corresponding to the refreshes additionally comprise one or more subsequent pulses causing the cells of the concerned row to be switched from an initial state into a final state depending on the voltages, in turn depending on the images to be displayed, applied to the columns, within a single time window, designated as a control window in the present specification. As is known, in the absence of erasure, during a write operation, it is possible to control the state changes in only one direction and, in the refresh cycle, it is necessary to repeat the write operation with signals of opposite polarity in the selection voltages.

Among the above said subsequent pulses corresponding to a write operation, almost always in the prior art a last pulse exists to which a transition between extreme states can correspond, depending on the data voltages existing in the control windows. Such a pulse is designated in this specification as a write pulse. It can be preceded by polarisation pulses and can be followed by stop pulses, as described in the scientific papers published by this inventor, to which direct or indirect reference has been made. Furthermore, it can be preceded by pulses aimed at compensating the effects of any manufacturing differences and of the temperature changes among the cells of the panel, as also described in Italian Patent Application RM93A000567 and in the paper by P. Maltese, on pages 371 and following of the proceedings of 13th International Display Research Conference (1993), available from the Society for Information Display.

The control window can be shorter than the comprehensive duration of all said subsequent pulses. The minimum time difference between selection voltages that can be employed in respect of two different rows is designated as the row (or line) addressing time and it determines the number of rows that can be addressed between two refreshes. Usually, it is the same as the total width of the control window, thereby avoiding undesired content overlapping between successive control windows. The selection time, on the other hand, is the time lapsing from the beginning of a first pulse and the end of the last pulse in the selection voltage, in respect of a selection operation. It should be small in comparison to the time interval between two successive refreshes, even if, on the other hand, it can be large with respect to the row addressing time.

At each refresh, therefore, the display control procedure provides for controlling the rows one by one in successive time windows. In one time window as defined by a selection voltage, the latching is controlled, in all of the cells in the corresponding row, depending on the previous states and on the data voltages applied to the column electrodes in the time window, as functions of the image to be modified.

In any case, selection voltages are applied to the electrodes of a first set and each of these voltages is associated, at each refresh of the display, to a different control time window for all of the cells corresponding to the electrode of the first set (the selected electrode). To the electrodes belonging to the second set data voltages are applied, each of which is formed by superposing the data voltage segments, applied within the different time windows associated to the selection voltages, the segments being designed for controlling all of the cells corresponding to the electrode belonging to the second set. Each pixel of the image to be displayed determines, in the case of a complete erasure of the previous image, the data voltage pertaining to the electrode of the second set within the time window corresponding to the electrode of the first set. In a general case, said data voltage can also depend on the previous images on the same pixel as well as on correction factors connected to the preceding and following data voltages.

It is known that, to avoid undesired effects of state changes of cells not belonging to the selected electrode, each data voltage segment must have the same average value (as computed in each corresponding window), independent of the corresponding cell and of the state it should take. In addition, each data voltage and each selection voltage must have identical average values (for the complete waveform), independent of the data assembly (of the image) and of the concerned electrode. Without jeopardising the broad concepts heretofore set forth, the above mentioned average value will be considered in the following description as a reference value with respect to which each voltage will be measured and it is therefore specified to be null.

All above described features are common to both the addressing method according to this invention and to the prior art addressing methods.

In the above already mentioned works of P. Maltese et al., systems and methods as well as a mathematical model are disclosed for controlling a matrix panel in which each picture element (pixel) ideally corresponds to the intersection of an element of a first electrode set and an element of a second electrode set and materially it corresponds to an electro-optical cell comprising a ferroelectric liquid crystal in the room existing between two facing electrodes belonging to said two electrode sets, said multistable cell featuring a minimum product pulse time×pulse voltage Amin, within the voltage range from one to eight tenths of the pulse voltage allowing the minimum pulse time Vtmin, when spaced apart rectangular pulses having alternately opposite polarities are applied switching the cell from an extreme state to the other one, when between the pulses a high frequency voltage of constant rms amplitude Vhf is applied, and in which selection voltages are applied to the electrodes of the first set and each of these voltages is associated, at each selection operation, to a different control time window, namely a time window allocated to the control by the voltages of the stable states by all the cells corresponding to the electrode of the first set, and in which data voltages are applied to the electrodes belonging to the second set and each of these data voltages is formed by superposing the data voltage segments for each pixel, namely the voltages applied within the different control time windows associated to the selection voltages and designed to control each of the cells corresponding to the electrode belonging to the second set, said voltage segments depending on each data item describing a pixel of the image to be displayed in correspondence to the electrode of the second set, in description pixel-by-pixel of the image, and wherein, upon extracting the possible voltage function of the time added to all said voltages to facilitate the implementation of the circuits generating them, each data voltage has an identical average value independent of the considered electrode, of the position of the pixel and of the data item, and each selection voltage has an identical average value as the data voltages, taken as a reference value for measuring each voltage.

IBM Technical Disclosure Bulletin, Vol 36, No. 1, January 1993, New York, U.S., pages 446–447, discloses a three slot drive scheme for multiplexing a ferroelectric liquid crystal shutter device, namely a method for controlling a ferroelectric liquid crystal panel. The scheme consists of on- and off-waveform for the column data lines and select and non-select for the row select lines. The on- and off-data have exactly opposite phases with voltage amplitudes varying between positive and negative polarities with a zero voltage period inbetween, such that a net zero DC is always maintained. The non-select waveform is a constant zero voltage. The select waveform consists of non-equal amplitude voltages V1, V2, V3, with V1 and V2 having the same polarity and V3 having opposite polarity.

It is an object of this invention to provide an addressing method overcomes the limitations of the fastest methods of the prior art and in particular to obtain shorter row addressing times or an extended range of operation conditions.

All or almost all addressing methods of the prior art provide for using an uninterrupted write pulse in the selection voltages. In slower methods, capable of operating also at low voltage, the control window completely contains the write pulse. The fastest methods of the prior art, just as the method of this invention, can utilise a control window shorter than the write pulse and are based upon the use of relatively high voltages comparable to Vtmin, so that the tensor dielectric properties of the FLC become important. Reference is particularly made to the "fast" and "superfast" methods, as described in the publications of the inventor and to the modes based upon unipolar pulses, as developed during the British project JOERS/Alvey, in connection with which reference can be made to an article of D. G. Mc Donnel et al, on page 654 and following of the above quoted 1993 SID Digest, as well as to the paper of J. R. Hughes and E. P. Raynes, on page 597 and followings, of vol. 13 (1993), with errata corrige on page 281 and following of volume 15 (1993), "Liquid Crystals", a scientific journal, Taylor and Francis, Great Britain, as well as in the references cited in said scientific papers. The addressing modes of both classes allow use of a control window shorter than the write pulse, overlapping the end of the write pulse and the beginning of a stop pulse, in the case of the "fast" and "superfast" modes, and overlapping the beginning of the write pulse, in the case of modes based upon unipolar pulses.

As it appears from the above mentioned references, preliminary to this invention the matrix addressing problems of FLC cells have been closely investigated and various novel addressing modes have been proposed and, more recently, a simplified model of a ferroelectric liquid crystal cell has been achieved, as well described in the above mentioned publications of P. Maltese et al. The model takes into account the tensorial dielectric properties of the material and it is capable of forecasting the operation of the cell in matrix addressing conditions.

BRIEF SUMMARY OF THE INVENTION

From, not yet published computations, applied to the model, it is possible to deduce some features, as herein set forth, of the desired or undesired control effect of a time function data voltage Vd(t) that, according to the polarity with which it is applied, is subtracted from or added to a selection Voltage Vs(t) within a time window Ft, consisting of a single time interval. In an ideal regime of small perturbations, that is negligible perturbations of the cell state at each instant, according to the polarity of Vd(t), if, according to the above quoted model, the cell state is defined by an angle fi(t), the control effect can be defined as an infinitesimal variation of the value of fi at the end of the window, according to the polarity of Vd(t). It is assumed that Ft has a short duration and that fi(t) varies therein within a short range. When Vd(t) is balanced as required, namely when it has a null average value and an integral which is null in Ft, for an ideal regime of high voltages with respect to Vtmin, most of the control effect is proportional to an angle function A(fi), having an amplitude proportional to the effective dielectric biaxiality of the liquid crystal. A(fi) is small at the extreme states under voltage, has a zero value at the central unstable state and has, as absolute values, two maximum values of opposite signs for states nearly at one fourth and three fourths of the range between the extreme states under voltage, the exact positions of which depend on other characteristics of the material and of the cell.

In all practical cases, even if the above simplificative first-approximation hypotheses are not valid, it has been found that, for addressing purposes, it is possible to use time windows of small duration, as it is forecast from the model, provided that the following indications derived therefrom are fulfilled:

1) For windows wherein Vs(t)=0, the undesired control effects are made minimum by Vd(t), such that both the average value and the first moment, that is the time integral computed within the window of the product of the function by the time, are null. It can be shown that this means that, within the window, the integral of Vd(t) from the start to a generic instant is a function with null average value. Crosstalk-compensated data voltages have already been defined in these terms in the second above mentioned work of Maltese et al. and are the basis for the "superfast" modes introduced therein.
2) For windows during the selection voltage pulses, the undesired control effects are small for constant Vs(t) within the windows, the more so when the previous indication is fulfilled, and they depend on the variations of fi within the windows. They can be nulled by adding to the constant voltage Vs(t) a corrective term, the correlation integral of which with Vd(t), namely the integral of the product computed within the window, substantially determines its effect.
3) The desired control effect can be made maximum by utilising a window such that fi is close to one of the two values corresponding to the maximum of the absolute value of the function A(fi) and by utilising, within the window, a Vs(t) such that its correlation integral with Vd(t), computed within the window, has a maximum absolute value. The achieved control effect is proportional to such an integral. For it to be maximum, as a matter of fact, the selection voltage Vs(t) should have the same sign alternances as Vd(t) within the control window.

While the first indication confirms already known concepts, the second and the third, not yet published indications are taken as a basis for this invention. The validity of the above set forth indications has been confirmed by the numerical simulation with the model, in a realistic range of great perturbations of short duration as well as by detailed experimental studies, for relatively high voltages. It has been found that, for a data voltage of given amplitude and duration, its control (finite) effect is greater when said voltage (and so the control window) is made to correspond to an interruption of the state change due to the previous and subsequent voltages, in an initial stage thereof. This corresponds to application of opposite polarity voltages that break the write pulse into two portions. This interruption in the simplest case corresponds to a single short pulse (which will be designated as a call-back pulse hereinafter) of opposite polarity with respect to the one previously and subsequently used to make the cell change its state. The call-back pulse can be replaced by a short pulse train or by a few half cycles of an oscillation and the same frequency can be used in the data. The control window is made to correspond to the interruption, rather than to the start or to the end of an uninterrupted write pulse, as in the prior art.

For the sensitivity to the data voltage segment of the final state reached in a cell to be high, said interruption is preceded by a first write pulse (write pre-pulse) having a time integral of the voltage that is large enough to effectively interact with the data voltage within the control window, if they are in time coincidence, and anyway such that, at its end, it results into a state of the cell sufficiently spaced apart from the extreme state under voltage, at the initial side. The duration of the necessary write pre-pulse will be relatively short for cells already in states spaced apart from the extreme states, as it frequently occurs for chevron cells at rest in the presence of data voltages having an insufficient amplitude to result in a high frequency stabilisation. It should be relatively long for cells having initial states slightly different from the extreme ones under voltage, in case of a high frequency stabilisation and when they are immediately preceded by pulses (for instance compensation or erasure pulses) of opposite sign.

Furthermore, the interruption is followed by a second write pulse (write post-pulse) which, in the preferred simplest cases, is a final pulse of the selection signal. At the end of the selection signal, the cell is in an intermediate condition when switching between the two extreme states that, according to the data voltage within the corresponding control window, does or does not overrun a non-return point and appears to be biased toward one of the two stable states, into which it subsequently relaxes sometimes only in part when a multistable cell and/or a mixture of microdomains of a number of states is concerned.

The above described behaviour corresponds, for a cell having a predetermined initial state, to the addressing method of this invention and it has been evidenced in chevron cells with liquid crystals having spontaneous polarisations between 2 and 15 $nC/cm^2$, both in experiments and in numerical simulations according to the above mentioned model.

The optical transmission of the cell was measured between two crossed polarizers, oriented at 22.5° and 67.5° with respect to the symmetry direction of the cells (rather than in the way providing the maximum contrast ratio). As it is known, when the polarizers are oriented in two possible ways at the above quoted angles, the maximum light transmission state of the cell in one way becomes the minimum transmission state in the other way and vice versa. Furthermore, when the polarizer arrangements are interchanged and voltages of opposite polarity are applied to a cell, its optical behaviour appears to be approximately the same.

The non-return point in the switching course, which falls at the middle point of the total range of the optical transmission according to the above quoted model, is often experimentally ascertained to be at about two thirds. In the preferred operation of the addressing method of this invention, the voltages of opposite polarity at the interruption, together with the alternate components, drive the cell from a state which is not beyond the non-return point, back to a state which is close to the extreme state under voltage at the initial side, said state being not too close thereto otherwise the control effect obtained is excessively reduced.

The method according to this invention overcomes the drawbacks corresponding to the restricted operation conditions of the "fast" and "super-fast" modes, wherein use is made of a control window located around the second maximum point of the absolute value of A (fi) found during the write operation, and an accurate positioning of the window is difficult due to operational and manufacturing tolerances. In addition, it overcomes the drawbacks of the unipolar modes that, in the absence of a write pre-pulse, are not compatible with an initial state of the cell within the control window, that is too close to an extreme state under voltage (for which the absolute value of A (fi) is not sufficient). In view of the above, unipolar modes require that chevron cells are used of a type giving lower optical states but stable in the absence of voltage, very spaced apart from the extreme states under voltage and they are not adapted to introduce compensation pulses for the operational and manufacturing tolerances of the panel.

The method according to this invention consists in using selection voltages comprising, at each selection operation, two (write) pulses of the same polarity, spaced apart by an interruption, wherein voltages of opposite polarities are present, said pulses and voltages of opposite polarity having absolute values of the time integral of the voltage within hereinafter specified limits, and in using control time windows corresponding to the interruption, as hereinafter specified. The absolute value of the time integral of the voltage during the second pulse (write post-pulse) is between 0.2 Amin and 5 Amin. The control time window associated to the selection voltage includes time intervals during which, in the interruption, voltages of opposite polarity are applied. Such time intervals as a whole extend for at least one fifth and no more than four fifths of said window and the absolute value of the integral of the selection voltage in the assembly of the above mentioned time intervals is between 0.05 Amin and 1 Amin.

As concerns the absolute value of the time integral of the voltage of the first of said two pulses having the same polarity (write prepulse), it is preferably less than 4 Amin and higher than one third of the above value for the voltages having opposite polarity within the interruption and within the control window.

If the preferred behaviour of a cell in the initial state responsive to the write operation is taken into account and the state of the cell is observed by means of its optical transmission measured between crossed polarizers, as above described, the write pre-pulse, at its end, drives the cell into a state intermediate between the extreme state under voltage at the initial side and the two thirds point of the total range of transmission, while the subsequent voltages of opposite polarity drive the cell into a state which is different by at least one hundredth with respect to the above said extreme state.

A portion of the write pre-pulse can precede the control window, at the beginning of which the concerned cell is driven into a state substantially independent of the data voltages up to that point applied. The duration of the write pulse is at a minimum when it is completely contained in the control window and is extended along a sufficient portion thereof for effectively interacting with the data voltage segment.

Providing during the interruption voltages of opposite polarity in said intermediate state, for instance in the form of a single or of a few call-back pulses, results into a high sensitivity to the contemporaneously applied data voltage segment. Since the obtained control effect is mainly related to the variations of the correlation integral, computed within the window, of the data voltage segment with the selection voltage, in order to obtain the extreme control effects, it is preferred to use data voltages that, within the window, change their sign together with the selection voltage. In the presence of a positive effective dielectric biaxiality of the liquid crystal exists, the alternances of the selection voltage within the window will be concurrent with the alternances of the data voltage segment which is utilised to latch the cell in a state opposite to the one at the beginning of the write pulse and they will be in opposition for storing an identical state. Complying with the above said indications, it is possible to adopt a number of solutions for the data voltage segments and for the selection voltage waveforms within the control window.

Even if the state of the cell obtained at the end of the control window is strongly dependent on the data voltage segment therein, it is still biased toward the state at the beginning of the write pre-pulse. The write post-pulse and any subsequent pulses in the selection voltage bring the cell, at their end, to an intermediate switching condition, at either side of the non-return point in its switching range, according to the state of the cell at the end of the control window, without the possibility that the data voltage segments existing in correspondence to the subsequent post-pulse and to the subsequent pulses substantially change the state reached at their end.

Outside of the control window, aiming at minimising the undesired effect of the data, the level changes of the selection voltages preferably will be substantially centered around times that define portions of the immediately preceding and subsequent data voltage segments having null average values for any data. This preferred condition applies in the first place to the beginning of the write pre-pulse and to the end of the write post-pulse. Said portions with a null average value preferably will be whole data voltage segments and will be by preference substantially crosstalk .

Such a term is hereinafter used for data voltage segments such that the time integral of the voltage, from the beginning of the corresponding control time window to a generic time therein, is a function of the time the average value of which within the control window is lower than one tenth of the peak value (that is substantially null).

Furthermore, according to the second indication provided by the model, values of the selection voltages that are constant in the time will be utilised in time coincidence with portions of the data voltages having average null values, with the addition of corrective terms that can be experimentally determined and approximately calculated with the model, in order to minimise the effect of the data voltages outside of the control window. It is possible to utilise superposed undulations, as well as level slopes and edge delays, that produce slight correlations with the data voltage segments. The above said portions will preferably correspond to groups of consecutive data voltage segments. An example of this is provided in the third embodiment hereinafter.

In some preferred embodiments, a single call-back pulse is wholly contained in a control window of larger width, for instance double width. In some embodiments, said pulse corresponds in time to the end of the window and data voltages of relatively small amplitudes appear to be suitable. In other embodiments, the call-back pulse is approximately centered with respect to the window and this allows the use of data voltages to be used substantially crosstalk compensated and having a larger amplitude.

The above described behaviour does not occur for cells in an initial state opposite to the responsive one, which remain in said state regardless of the data voltages. As is known, to make also these cells take the desired state, it is possible to effect a second selection operation with a selection voltage of opposite sign and with the same data voltage. This doubles the addressing time for each row of the panel and can be advantageously avoided when the state of the cell at the beginning of the write pre-pulse is made independent of the image displayed before the refresh. As is known this role can be accomplished by a previous erasure pulse, or by a previous sequence of erasure pulses, at the end of which the optical transmission is substantially independent of the state of the cell at the beginning of the refresh time.

The above mentioned blanking pulse advantageously can be separated from the subsequent (two or more) pulses by a pause having a duration that can also be variable, provided that is sufficiently long. Such duration is preferably between the comprehensive duration of the interruption and of two pulses of the same polarity, for first and second write (write pre-pulse and post-pulse), according to this invention, and one half of the minimum time between two successive refreshes. Furthermore, it is possible to add, before the two write pulses, or even between them or after them, further pulses for compensating for the effect of any manufacturing disuniformities and temperature variations, by adapting the descriptions of the mentioned patent application and of the latest work of P. Maltese to the new case. One or more (compensation) pulses of opposite polarities, having an absolute value of the time integral of the voltage between 0.8 Amin and 5 Amin will be preferably inserted before the write pulses.

It will be additionally apparent that, in the above described selection voltage pulse succession, under the term pulse, a voltage is to be meant substantially having always the same polarity, even if having a variable value, applied in a finite time interval. It should also be admitted that further pulses or pauses having absolute values of the corresponding integrals of the voltage with respect to time lower than 0.2 Amin can be introduced also into its end portions, without substantially modifying the selection waveform or the just described behaviour. In view of the above, the description of this invention and in particular the description of the procedure for counting the pulses omits considering any presence in the selection voltage of further pulses or pauses, other than the above described pre-write and call-back pulses, the corresponding integrals of the voltages with respect to time of which have values lower than 0.2 Amin.

A drawback of the above described waveforms, which has been found in chevron cells with liquid crystals having a spontaneous polarisation between 2 and 15 nC/cm$^2$, when only write pulses, interruption voltages and a single blanking pulse are employed, is due to the fact that, for high efficacy reasons, the single blanking pulse should be larger than the one requested for it to compensate within the single refresh operation the direct current component deriving from the subsequent portion of the selection voltage. It is possible and necessary to null the DC component of the selection voltages, either by using opposite polarities for the pulses in sufficiently close successive refresh operations, or by adding small DC offset voltages, such as generated by a possible capacitive coupling. It is often preferable, however, that the DC component be nearly null within the selection time. This is possible by inserting further pulses before the above mentioned blanking pulse, so as to obtain an average lower value for the selection voltage in the refresh time. As a matter of fact, it has been found satisfactory to this effect that a single (balancing or first erasure) pulse be inserted having opposite polarity with respect to the subsequent pulse by which the erasure is completed.

It has been found that it is necessary, in order to let the panel operate according to this invention, to use selection voltages having amplitudes comparable to Vtmin, particularly with respect to the voltages of opposite polarity applied during the interruption. By the same reasoning, for predetermined voltage levels, depending for instance on the integration technology employed for manufacturing the driver circuits, it will be advisable to use cells characterized by a Vtmin as small as possible. It has been found that it will be convenient to use peak amplitudes in the range from one fifth of to twice the voltage Vtmin, with respect to voltages of opposite polarity during the interruption, and to use preceding and following pulses having their peak amplitudes lower than or equal to four thirds of the peak amplitude of the voltages of opposite polarity during the interruption.

As far as the voltages applied to the cells after and between the row refresh pulses are concerned, they appear to be equal to the differences between any high frequency stabilisation voltages, contained in the row selection voltages, and the data voltages applied to the columns. It appears to be convenient that the rms amplitude of such difference voltage be sufficient to cause a stabilisation effect, according the definition given in the introductory portion of this specification and that it be constant as a function of the time as well as independent of the data. As is known, this result can be obtained when the waveforms for each data item have null correlation with any stabilisation voltages that are present of the rows and have a rms amplitude value independent on the desired optical transmission value (white or black or intermediate shade) for the pixel.

For instance, the data voltage can be made up of three successive rectangular pulses having the same amplitude and opposite polarities, whose products time—voltage upon being added together are balanced; when the desired shade is varied, the product time—voltage of the first pulse increases, if such product of the third pulse decreases or vice-versa The number of pulses is reduced to two in connection to particular shades.

The substantial crosstalk compensation condition together with the balance and with the constant rms amplitude conditions, can be satisfied, for all shades, by data voltages consisting of four pulses having opposite polarities and durations variable under fulfilment of the above said conditions. For instance, when the time integrals of the first and second pulses increase, the time integrals of the third and fourth ones decrease. In the case of particular shades, the consecutive pulse are reduced to three. For instance, for rectangular pulses having the same amplitude and opposite polarities, this corresponds to disappearing of one of the extreme pulses and to equal durations of the first and last remaining pulses.

When, as it often occurs in view of implementation requirements, it is desired to use for the data voltages steps having a duration multiple of a time module, it is possible to find a number of data voltage segments balanced and crosstalk compensated or substantially crosstalk compensated, which will be selected in order to create different shades in the optical transmission of each cell. An example hereof is provided by the fourth embodiment hereinafter described.

For the row stabilisation voltage, a square wave having a sufficiently high frequency can be used. It is been found, however, that it is convenient not to use stabilisation voltages and to increase the rms amplitude of the data voltages, thereby obtaining a high frequency stabilisation effect of the cells. In the best conditions, this result can be achieved by a rms amplitude in the range from one tenth to four thirds of the peak amplitude of the row voltages.

A preferred solution for the data voltages, which enables smaller amplitudes to be used, utilises control windows each consisting of a number of sub-windows, namely spaced apart time intervals, one of which corresponds to the interruption voltages. According to a preferred embodiment, a second sub-window overlaps the end of the write post-pulse that is immediately followed by a stop pulse. An example hereof is given by the third embodiment hereinbelow described. The control method according to this invention is combined with the "fast" or "super-fast" addressing technique of the prior art, performed in the second sub-window. In particular, when the call-back pulse corresponds to the second half of the first sub-window and when a "fast" addressing step is carried out in the second sub-window, data voltages will be crosstalk compensated.

As it is known from and common practice in the liquid crystal display technology, it is evident that, for instance aiming at decreasing the peak amplitudes of the signals generated by the row driving circuits, it will be possible to substitute, for the above described selection voltages and data voltages corresponding to this specification, an equivalent set obtained by adding a single voltage function of the time to all components of the set. In fact, even if it modifies each signal, such addition does not modify the voltage differences at the ends of each electro-optical cell. Its use will be preferred since in general it will result in simplification of the practical implementation of the driver circuits.

Further particulars and advantages as well as characteristics and construction details will be evident from the following description with reference to enclosed drawings wherein four preferred embodiments are shown by way of illustration and not by way of limitation.

In all examples, use has been made of a liquid crystal SCE4, having spontaneous polarisation of 6.1 nanoCoulomb/cm$^2$ at 20° C., supplied by BDH at Poole (Great Britain), in a matrix panel, comprising chevron cells, wherein a layer of 1.7 micrometers thickness of the liquid crystal is oriented due to contact with the surfaces of a polymer rubbed according to the known prior art, thereby forming bistable cells, the operation of which has been observed at about 18° C.

The optical transmission of a cell has been measured in arbitrary units between two crossed polarizers, oriented at 22.5° and 67.5° with respect to the rubbing direction of the surfaces in contact with the liquid crystal in the cell. It is clear from the above description that complementary optical transmissions or voltages of opposite polarities with respect to the illustrated ones are perfectly contemplated by the hereinbelow described examples and that, in subsequent selection operations, it is possible to utilize, for the selection voltage, variable polarities.

BRIEF DESCRIPTION OF THE DRAWINGS

In all drawings, the voltages used and the optical transmissions obtained are shown by their respective diagrams as a function of the time. The diagrams are exact reproductions of the results of the numerical simulation with the model and with the typical FLC cell, as detailedly described in the above quoted works of the inventor and collaborators; such diagrams suitably describe the operation according to the invention of the matrix panel used and of other panels that could depart therefrom in respect of manufacturing details.

In the drawings relating to a first embodiment.

Figure 1:
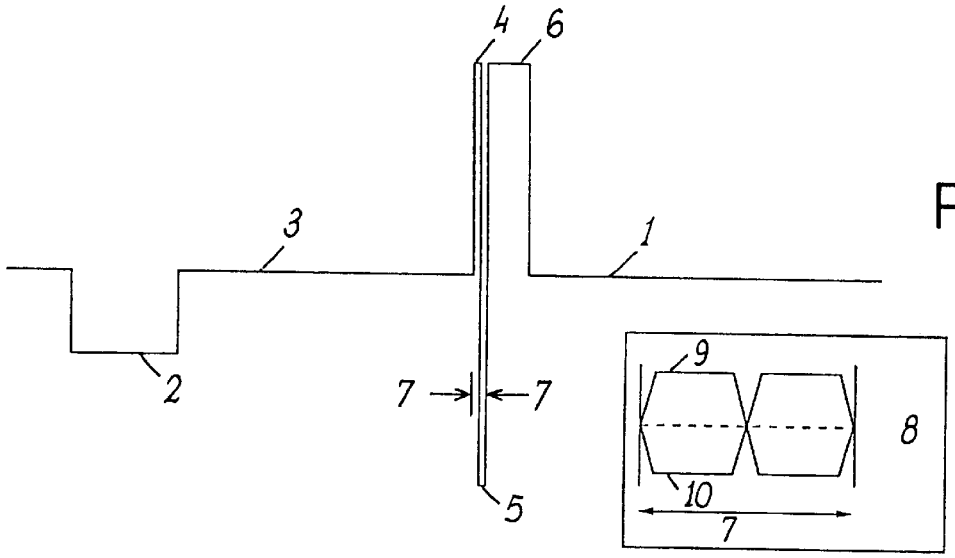
FIG. 1 shows, in correspondence to a refresh operation, the selection voltage used, the related control window and two values of the data voltage segment within the window, while, in respect of a cell controlled therewith and in the same time scale.
Figure 4:
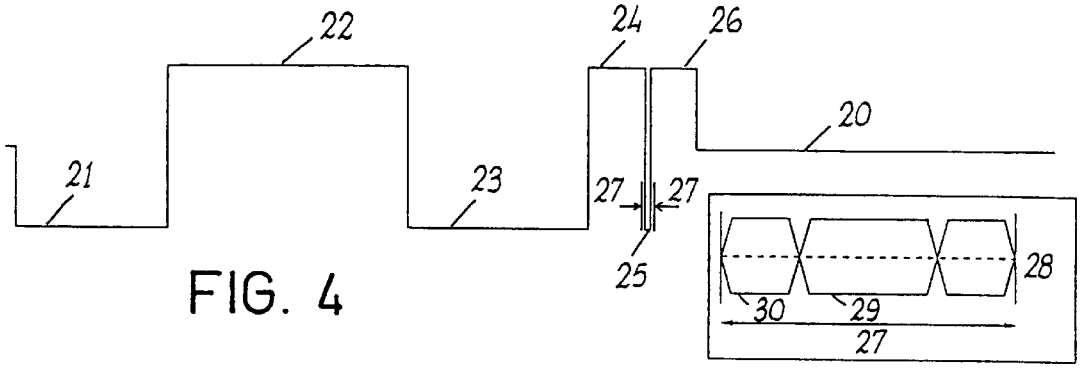
Figure 5:
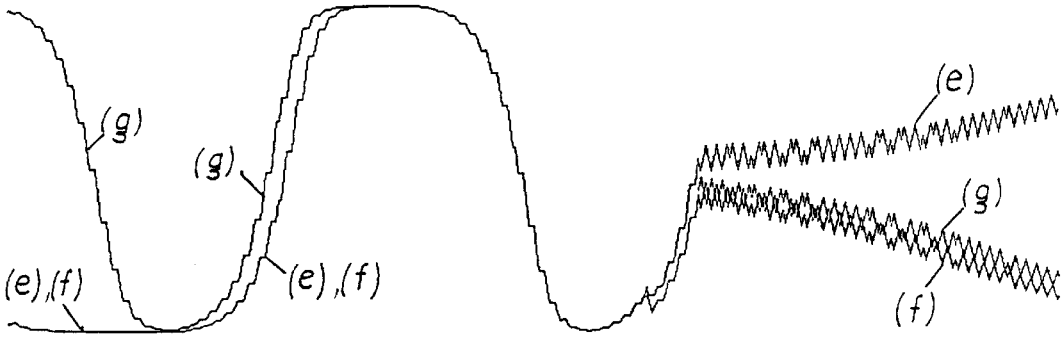
Figure 6:
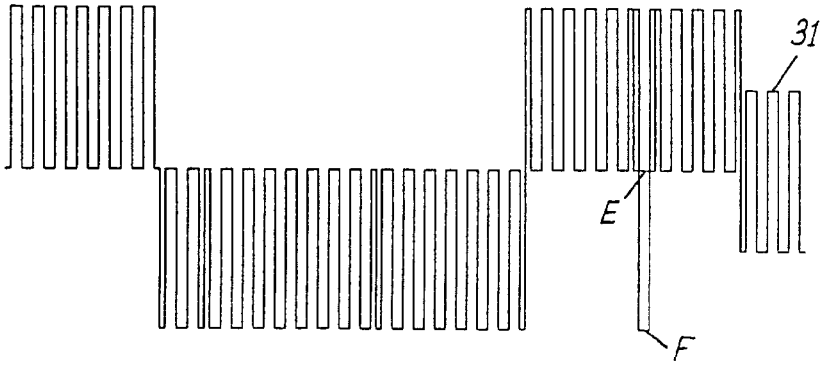

In the drawings relating to a second embodiment:

FIG. 4 shows, in correspondence to a refresh operation, the selection voltage used, the related control window and two cases of the data voltage segment within the window, while, in respect of a cell controlled therewith and in the same time scale, FIG. 5 shows the optical transmission in three different operation conditions and FIG. 6 shows, in expanded time scale, two variations of the difference voltage at the ends of the cell.

In the drawings relating to a third embodiment:

FIG. 7 shows, in correspondence to a selection operation, the selection voltage used, with a control window divided into two spaced apart sub-windows and four cases of the data voltage segment within the so assembled window, while, for a cell controlled therewith and in the same time scale, FIG. 8 shows four variations of the difference voltage at the ends of the cell and FIG. 9 shows the optical transmission in five different operation conditions.

Figure 10:
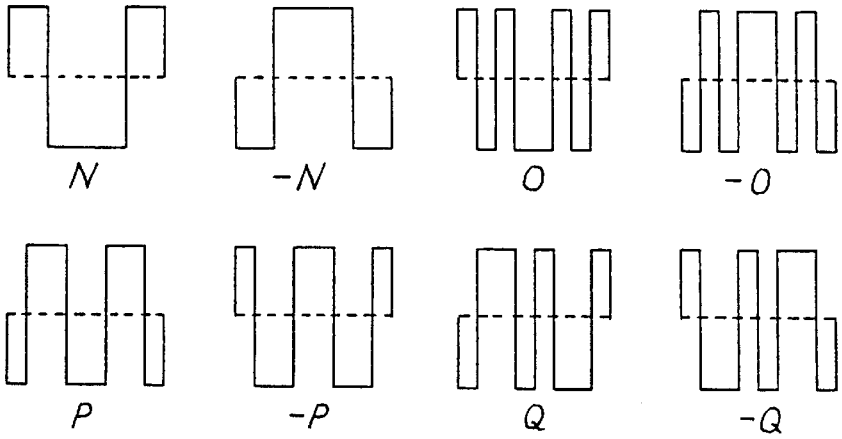
Figure 11:
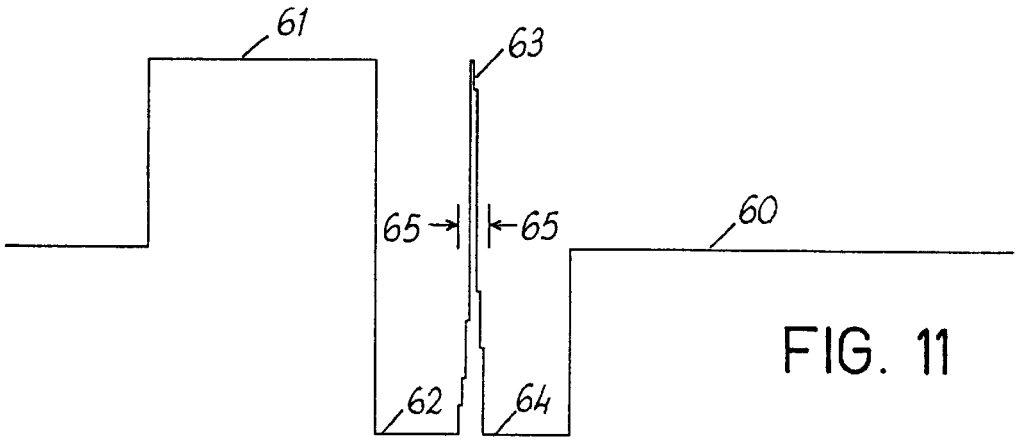
Figure 12:
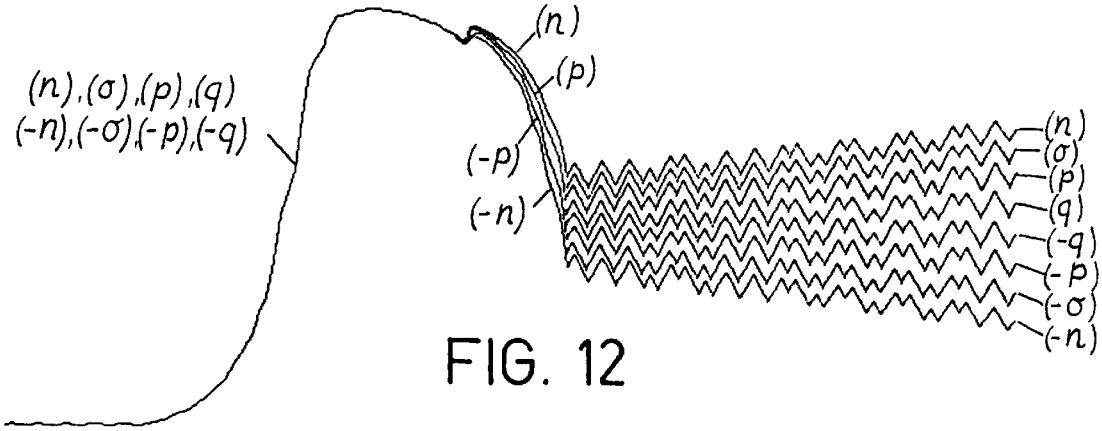

Lastly, in the drawings relating to a fourth embodiment:

FIG. 10 shows, in expanded time scale, the eight variations used for the data voltage segment within the windows, FIG. 11 shows, in correspondence to a selection operation, the selection voltage used and the related control window and FIG. 12, in the same time scale, the optical transmission of a cell controlled by a selection voltage according to FIG. 11 when the eight variations of the data voltage appearing in FIG. 10 are used within the control window.

DETAILED DESCRIPTION OF THE INVENTION

In the first embodiment, use has been made for each row of a selection voltage having null average value and consisting of four pulses. FIG. 1 shows such selection voltage 1 in correspondence to a refresh operation. The first pulse 2, having a smaller amplitude than the following ones, performs the erasure of the previous image, thereby driving all cells of a row into the same state, for instance corresponding to black. It is separated by a pause 3 from the voltages relating to the selection operation, namely the two write pulse 4 and 6 and the call-back pulse 5 (by which the write operation is interrupted), corresponding in this example to the second half of the control window 7 associated to voltage 1. The inset 8 shows, in expanded time scale, for the data voltage segment in each control window, the two cases used, namely 9, corresponding to a control for staying in the state reached with the erasure operation (for instance, a state of minimum transmission or briefly a black state), for a pixel of the row to which voltage 1 is applied, and 10, corresponding to an opposite control for switching to the other state.

Figure 2:
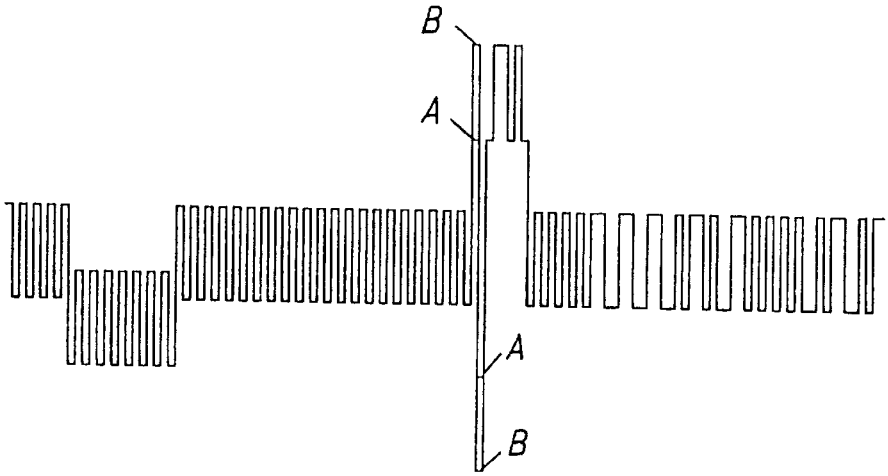
FIG. 2 shows two variations of the difference voltage at the ends of the cell and FIG. 3 shows the optical transmission in four different operation conditions.

FIG. 2 shows, in the same time scale, the two variations A and B of the difference voltage 11 at the ends of a cell controlled by the selection voltage 1 and by two not shown data voltages, which are different only in correspondence to the control window 7 associated to the selection voltage 1. For instance, variation A practically corresponds to the worst case for white and variation B to the best case for black.

Figure 3:
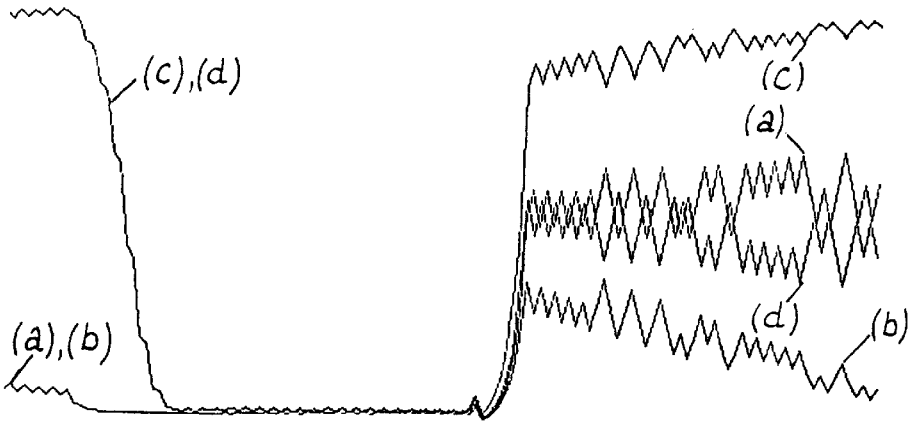

FIG. 3 shows, in the same time scale, the corresponding diagrams of the optical transmission in the two extreme cases: (a) for a cell to which voltage A is applied and that should change its state, and (b) for a cell to which voltage B is applied and that should not change its state. Furthermore, additional extreme cases (c) and (d) are shown corresponding to a data voltage the sign of which is inverted outside of the control window with respect to the one that generates the voltages shown in FIG. 2. It is clear that, in a general case, diagrams intermediate between (a) and (c) in the white case and between (b) and (d) in the black case are obtained for the transmission, but transmissions intermediate between (a) and (d) will never be obtained. In a time scale longer than the one shown, but small with respect to the refresh time, the (bistable) cell relaxes to one or the other of the two extreme stable states. As a result thereof, the variability of the light transmitted within the refresh interval between the various cases corresponding to black or to white is much lower than the span appearing in FIG. 3 and can be considered as effectively acceptable.

More precisely, as concerns the selection voltage, amplitudes of 65 volts for writing and 26 volts for erasing and, as concerns the data voltage, amplitudes of 13.5 volts have been used. A row addressing time of 60 microseconds has been achieved.

An advantage of the first exemplary embodiment, when the erasure results into a black state, is the reduced perception of light flashes by the observers at each selection operation. A first drawback is the above mentioned relatively noticeable effect of the data voltages outside of the control window on the transmission of the cell at the end of the selection pulses. It can be nearly eliminated by use of crosstalk compensated data voltages and by changes in the level of the selection voltage only within the control window and at the boundaries of the control windows associated to other selection voltages.

In an exemplary embodiment slightly modified with respect to the embodiment shown in FIGS. 1, 2 and 3, the call-back pulse 5 has been anticipated by one half of its duration, while the other transitions of the selection voltage 1 and the control window 7 have been kept constant, and by utilizing, for data, signals such as shown in the inset 28 of FIG. 4, in stead of the ones shown in inset 8. A better operation according to this invention has been achieved, maintaining the same above mentioned advantages.

A second drawback is the restricted range of correct operation conditions, which depend on the thickness and on the temperature of the cell. It can be noticeably reduced by use of compensation pulses in the selection voltage. A third drawback is the defective efficacy of the erasure pulse, which results into a dependence of the obtained transmissions on the previous state of the cell. The use of double erasure pulses enables also this drawback to be eliminated, even if balancement conditions of the dc component of the selection voltage are maintained at each refresh operation. Thanks to the elimination of these three undesired effects on the cell transmission at the end of the selection operation, a lower amplitude of the useful control effect becomes sufficient and the use of lower selection voltages and/or of higher data voltages becomes possible.

A second exemplary embodiment comprises the above mentioned improvements by which the use of nearly equal amplitudes for the selection voltages and for the data voltages is made possible. For each row, use has been made of a selection voltage 20 having null average value and consisting of six pulses, as shown in FIG. 4, corresponding to a refresh operation. The first (balance) pulse 21 and the second (erasure) pulse 22 effect the erasure of the previous image and are followed by a compensation pulse 23. The first write 24, call-back 25 and second write 26 pulses follow. The subsequent selection voltages have equal patterns, delayed by multiples of the control window duration. The call-back pulse 25 corresponds to the central half of the control window 25 associated to voltage 20. The inset 28 shows, in expanded time scale, for the data voltage segment in each control window, the two examined cases, namely case 29 corresponding to switching a pixel to the state of maximum light transmission (white) and case 30 corresponding to switching a pixel to the state of minimum light transmission (black).

FIG. 5 shows, in the same time scale, the diagrams of the optical transmission of the cell in connection with the two extreme cases, for instance corresponding to the worst white (e) and to the best black (f). A third diagram (g) is additionally shown, corresponding to the worst case for black, wherefrom the middle portion has been omitted in order to avoid garbling of the representation due to its overlap to (f).

FIG. 6 shows in expanded time scale the corresponding variations E (for worst white) and F (for best black) of the difference voltage 31 at the ends of a cell controlled with the selection voltage 20 and with two not shown data voltages, different only in correspondence to the control window 27 associated to the selection voltage 20. Transmission (g) of FIG. 5 is obtained in connection with an inverted sign data voltage outside of the control window with respect to the one producing the voltage shown in FIG. 6. It should be understood that, in the general case of black, diagrams intermediate between (f) and (g) are obtained for transmission, while transmissions intermediate between (e) and (g) will never be obtained.

More precisely, amplitudes of 13 volts have been employed for the selection voltage and of 12 volts have been employed for the data voltage. Thus a row addressing time of 50 microseconds has been achieved.

The third exemplary embodiment corresponds to FIGS. 7, 8 and 9, which show, in the same time scale, the sole selection operations for a cell initially in the state corresponding to black. The control method of the first embodiment, applied in a first sub-window of the control window, is combined with the "fast" control method of the prior art, which is applied in a second sub-window. This enables not only higher overall control effects at the end of the selection operation, but also intermediate effects corresponding to discrepant controls within the two sub-windows to be obtained. In such a case, the effects of data within the first sub-window appear to be much higher than those of data within the second one and the data within the two sub-windows can be associated to bits of different weights in a binary coding of the shades to be displayed in a pixel.

For each row, use has been made of a not balanced selection voltage 40, as shown in FIG. 7. It comprises the first write pulse 41, the call-back pulse 42 and the second write pulse 43, as well as the stop pulse 44. The oscillations 45, at the same frequency as the data voltages, superposed to the maximum level of the pulses, have been determined so as to minimize the undesired effects of the contemporaneously present data voltage segments, outside of the control window. Furthermore, the peak values of the voltages have been kept constant, in the presence of allowable maximum voltages for the circuits generating them.

In this exemplary embodiment, the long duration of pulse 43, longer than the duration of corresponding pulses in other embodiments, at its end drives in any case the state of the cell to a point, clearly beyond the middle point between the two extreme states, corresponding to a state wherein the cell is again responsive at the most to application of additional voltages having a null average value, according to the "fast" or "superfast" control techniques of the prior art, while pulse 44 drives again the state of the cell near to said middle point, at either side according to the data voltages encountered.

The control window associated to the selection voltage 40 consists of two sub-windows 46 and 47 of equal durations, spaced apart by a time interval corresponding to four times the duration of each of them. The second half of the first sub-window 46 corresponds to call-back pulse 42 and the second sub-window is centered around the end of the second write pulse 43 and the beginning of the stop pulse 44. The subsequent selection voltages have equal patterns, delayed by multiples of the overall duration of the control windows, which is twice the duration of the sub-windows. Inset 48 shows, in expanded time scale, the two cases used for the data voltage in each control sub-window, resulting into four combinations. Cases 49 and 50 correspond to driving a pixel to a state of maximum light transmission (white) and cases 51 and 52 correspond to driving a pixel to a state of minimum light transmission (black). The data voltage alternately consists of first and second sub-windows. Each first sub-window is followed by the second sub-window associated to a previous selection operation. In this embodiment, each first sub-window is followed by the second sub-window associated to the second previous selection operation, so that the time interval between two sub-windows associated to the same selection operation is four times the duration of each sub-window.

FIG. 8 shows, in the same time scale as in FIG. 7, the four variations HL, for maximum white; HM, for subdued white: IL, for subdued black and IM, for maximum black, of the difference voltage 53 at the ends of a cell controlled by the selection voltage 40 and by not shown data voltages, which are different only in correspondence to the control window consisting of the two sub-windows 46 and 47 and associated to the selection voltage 40.

FIG. 9 shows, in the same time scale, the corresponding diagrams of the optical transmission of the cell (hl), (hm), (il) and (im).

Furthermore, the end portion of a fifth diagram 54 is shown corresponding to data voltage segments, equal within the control window, and all of which having inverted sign in the other sub-windows, with respect to the case corresponding to (il) and lL. The overlap of such a diagram and (il) evidences the accuracy with which it has been possible to minimize the undesired control effects by the data voltages outside of the window.

More precisely, amplitudes of 48 volts have been employed for the selection voltages and amplitudes of 9 volts have been employed for the data voltages. Thus, an overall row addressing time of 60 microseconds, corresponding to two sub-windows of 30 microsecond duration, has been achieved.

A fourth exemplary embodiment is shown in FIGS. 10, 11 and 12. The first one shows eight variations employed for the data voltage segment in each control window. The last two Figures show, in the same time scale, the sole selection operations for cell initially in a state corresponding to black. The control method of the second example has been changed in this embodiment so as to make it adapted to realise a scale of eight shades in combination of cells wherein intermediate states or mixtures of microscopic domains of different states are stable. Aiming at minimising the undesired effects of data outside of the control window, functions of the time with null average values and substantial crosstalk compensation must be chosen therefor. The four two-value (exactly compensated) functions, constant in each of eight consecutive time intervals N, O, P and Q, and the corresponding sign inverted functions -N, -O, -P and -Q, shown in FIG. 10, have been employed. Such functions appear to be exactly compensated in view of the intermodulation and are mathematically orthogonal, namely they have null correlation integrals.

For each row, a not balanced selection voltage 60, as shown in FIG. 11, has been used. It comprises the compensation pulse 61, the first write pulse 62, the lower voltages and the shaped call-back pulse 63 and the second write pulse 64, while the corresponding control window is designated 65. In order to achieve different control effects proportional to assigned weights, when the sign of a data item is changed according to one of the four functions, the shape of the lower voltages and of pulse 63 in window 65 has been determined by summing said functions, in amplitudes proportional to the established weights. Aiming at obtaining equidistant shades, weights 7, 5, 3 and 1 have been chosen for functions N, O, P and Q, respectively. By this choice, it has been possible to obtain, in respect of the driving signal to be applied during the interruption of the write operation, the shape of a single call-back pulse and of multiple voltage steps, and the case corresponding to a minimum peak amplitude for the pulse has been chosen. It is also possible, however, to use different and more complex signals, obtainable for instance by exchanging weights and signs within the illustrated functions and/or by replacing the constant levels in the steps with ramps having the same average values.

All transitions of the selection voltages outside of the control windows take place at the boundaries of the control windows relating to the other selection voltages which are timely shifted with respect to each other by multiples of the control window duration. This measure, together with the use of crosstalk compensated data voltages, minimises the effect exerted upon a cell by data intended to control other cells.

FIG. 12 shows, in the same time scale, the corresponding diagrams of the optical transmission of cell (n), (o), (p), (q), (-q), (-p), (-o) and (-n), the initial portion of some of which having been omitted to avoid garbling the figure due to overlap thereof with other ones.

More precisely, amplitudes of 40 volts have been employed for the selection voltage and amplitudes of 13 volts have been used for the data voltages. A row addressing time of 36 microseconds has been obtained, with an overall duration of the pulses shown in FIG. 6 corresponding to 16 times the row addressing time.

It should be understood that the two last examples of the control method are completed, at each refresh operation, by not shown operations wherein the dc component appearing in the illustrated portion of the selection voltage is preferably balanced and said operation can consist of a previous erasure operation or of a selection operation of the cell that initially were in the other state. An erasure operation can be performed as in the first or in the second example by means of single or double pulses of the selection voltage, which can be followed by a pause, immediately before the time interval shown in FIGS. 7, 8 and 9 or 11 and 12. Otherwise, it is possible to complete a panel refresh operation by means of selection voltages such as those shown in FIGS. 7 or 11, but with opposite polarities, while the data voltages are repeated with the same polarities.

The preferred embodiments of this invention have been described hereinbefore, but it should expressly be understood that those skilled in the art can make other variations and changes, without so departing from the scope thereof.

I claim:

1. A method for controlling a matrix panel in which each of a plurality of picture elements includes an electro-optical bistable cell with a ferroelectric liquid crystal, the bistable cell switching between a first state and a second state in response to spaced apart rectangular switching pulses having alternately opposite polarities and a constant rms voltage amplitude Vhf applied between the spaced apart rectangular switching pulses, when the switching pulses have a large enough product of a switching pulse time and a switching pulse voltage to have a minimum value Amin when the switching pulse voltage ranges from one to eight tenths of a minimum voltage Vtmin that allows a minimum switching pulse time, the method comprising:

applying a selection voltage waveform to at least one bistable cell, the selection voltage waveform including a first voltage pulse of a first polarity, an interruption including one or more voltages of a second polarity opposite the first polarity, such that an absolute value of the time integral of the one or more voltages is in the range of 0.05 Amin to 1 Amin and a second voltage pulse of the first polarity, such that an absolute value of a time integral of the second voltage pulse is in the range of 0.2 Amin to 5 Amin and is greater than the absolute value of the time integral of the one or more voltages occurring during the interruption, so as to produce a control time window for the at least one bistable cell that includes a time interval corresponding to the occurrence of the one or more voltages during the interruption, and extending in total for at least one fifth and not more than four fifths of an entire duration of the control time window; and applying a data voltage waveform to the at least one bistable cell during the control time window.

2. A control method according to claim 1, wherein an absolute value of the time integral of the first voltage pulse is less than 4 Amin and more than one third the absolute value of the time integral of the one or more voltages occurring during the interruption.

3. A control method according to claim 1, wherein the one or more voltages occurring during the interruption consist in no more than three half cycles of an alternate voltage.

4. A control method according to claim 1, wherein polarity changes of the data voltage waveform correspond in time to polarity changes of the selection voltage waveform occurring during the control time window.

5. A control method according to claim 1, wherein a peak amplitude of the one or more voltages occurring during the interruption is between ⅕ Vtmin and 2 Vtmin.

6. A control method according to claim 1, wherein the selection voltage waveform further includes one or more voltage pulses of the second polarity prior to the first voltage pulse, an absolute value of a time integral of the prior one or more voltage pulses ranging between 0.8 Amin and 5 Amin.

7. A control method according to claim 1, wherein the selection voltage waveform further includes at least one additional voltage pulse or interruption.

8. A control method according to claim 1, wherein voltage level changes in the selection voltage waveform that do not occur during the control time window are substantially centered on time instants that delimitate immediately preceding and following portions of the data voltage waveform that have a null average value.

9. A control method according to claim 1, wherein portions of the data voltage waveform have a null average value, and portions of the selection voltage waveform corresponding to the null average value portions of the data voltage waveform have a substantially constant voltage level.

10. A control method according to claim 1, wherein the selection voltage waveform further includes corrective voltage pulses correlating to portions of the data voltage waveform outside of the control time window.

11. A control method according to claim 1, wherein voltage levels of the selection voltage waveform within the control time window correlate with variations in the data voltage waveform according to a scale of different correlation levels.

12. A control method according to claim 1, wherein the control time window is divided into subwindows spaced apart over time.

13. A control method according to claim 12, wherein the control time window is divided into a first subwindow and a second subwindow spaced apart over time, such that the second subwindow overlaps an end of the second voltage pulse.

14. A control method according to claim 1, wherein the selection voltage waveform includes a high frequency voltage having a constant rms amplitude.

15. A control method according to claim 1, wherein differences between voltage levels of the data voltage waveform and voltage levels of the selection voltage waveform other than the first and second voltage pulses have a substantially constant rms amplitude.

16. A control method according to claim 1, wherein a high frequency stabilization of the electro-optical bistable cell is carried out.

17. A control method according to claim 1, wherein an rms amplitude of the data voltage waveform is between one tenth and four thirds of a peak amplitude of the selection voltage waveform.

18. A control method according to claim 1, wherein the data voltage waveform includes three consecutive pulses of opposite polarity, such that, when a time integral of the first consecutive pulse is increased, a time integral of the third consecutive pulse is decreased, and when a time integral of the first consecutive pulse is decreased, a time integral of the third consecutive pulse is increased.

19. A control method according to claim 1, wherein a time integral of the data voltage waveform from a beginning of the control time window to a generic time instant within the control time window is a function of time wherein an average value in the control time window is less than one tenth of a peak value.

20. A control method according to claim 1, wherein the data voltage waveform includes four consecutive pulses of opposite polarity, such that, when a time integral of the first and second consecutive pulses is increased, a time integral of the third and fourth consecutive pulses is decreased, and when a time integral of the first and second consecutive pulses is decreased, a time integral of the third and fourth consecutive pulses is increased.

21. A liquid crystal display, comprising:

a plurality of picture elements, each picture element including an electro-optical bistable cell with a ferroelectric liquid crystal, the bistable cell switching between a first state and a second state in response to spaced apart rectangular switching pulses having alternately opposite polarities and a constant rms voltage amplitude Vhf applied between the spaced apart rectangular switching pulses, when the switching pulses have a large enough product of a switching pulse time and a switching pulse voltage to have a minimum value Amin when the switching pulse voltage ranges from one to eight tenths of a minimum voltage Vtmin that allows a minimum switching pulse time;

selection voltage waveform application means, for applying a selection voltage waveform to at least one bistable cell, the selection voltage waveform including a first voltage pulse of a first polarity, an interruption including one or more voltages of a second polarity opposite the first polarity, such that an absolute value of the time integral of the one or more voltages is in the range of 0.05 Amin to 1 Amin and a second voltage pulse of the first polarity, such that an absolute value of the time integral of the second voltage pulse is in the range of 0.2 Amin to 5 Amin and is greater than the absolute value of the time integral of the one or more voltages occurring during the interruption, such that a control time window is produced for the at least one bistable cell that includes a time interval corresponding to the occurrence of the at least one voltage during the interruption, and extending in total for at least one fifth and not more than four fifths of an entire duration of the control time window; and data voltage waveform application means, for applying a data voltage waveform to the at least one bistable cell during the control time window.

22. A liquid crystal display according to claim 21, wherein the ferroelectric liquid crystals are of the smectic C chiral type with a dielectric tensor corresponding to positive effective biaxiality.

23. A liquid crystal display according to claim 21, wherein the ferroelectric liquid crystals have a ratio of spontaneous polarization to absolute effective dielectric biaxiality of less than 80 volts/micrometer.

24. A liquid crystal display according to claim 21, wherein the ferroelectric liquid crystals have a spontaneous polarization between 2 and 15 $nC/cm^2$.

* * * * *